United States Patent [19]

Ladinsky

[11] 4,039,082

[45] Aug. 2, 1977

[54] MULTIPLE PAPER ITEM HOLDER

[76] Inventor: George Ladinsky, c/o P.O. Box 18992, Dockweiler Station, Los Angeles, Calif. 90007

[21] Appl. No.: 585,341

[22] Filed: June 9, 1975

[51] Int. Cl.[2] ..... A47F 7/00

[52] U.S. Cl. ..... 211/45; 108/26; 108/31; 211/133; 248/206 A

[58] Field of Search ..... 108/25, 26, 26.2, 28, 108/29, 30, 31, 111; 211/11, 45, 52, 124, 133, 177, 71, DIG. 1; 248/206 A, 249

[56] References Cited

U.S. PATENT DOCUMENTS

| | | | |
|---|---|---|---|
| 918,196 | 4/1909 | Price | 211/45 X |
| 1,185,607 | 5/1916 | Templin | 211/45 |
| 1,797,884 | 3/1931 | Talabac | 211/133 |
| 1,855,314 | 4/1932 | Schacht | 211/71 X |
| 1,980,587 | 11/1934 | Hayes | 211/45 X |
| 2,222,091 | 11/1940 | Schray | 108/28 |
| 2,254,770 | 9/1941 | Bitney | 108/111 |
| 2,721,603 | 10/1955 | Faulconer | 297/254 |
| 2,842,268 | 7/1958 | Gumplo | 211/45 |
| 2,977,082 | 3/1961 | Harris | 248/206 A |
| 3,015,466 | 2/1962 | Levy | 211/177 X |
| 3,190,599 | 6/1965 | Margulis | 248/206 A |
| D. 161,559 | 1/1951 | Warp | 211/45 X |

FOREIGN PATENT DOCUMENTS

| | | | |
|---|---|---|---|
| 168,798 | 10/1959 | Sweden | 108/111 |
| 985,785 | 3/1965 | United Kingdom | 211/133 |
| 271,563 | 5/1927 | United Kingdom | 211/71 |

*Primary Examiner*—Roy D. Frazier
*Assistant Examiner*—Thomas J. Holko

[57] ABSTRACT

A multiple-item holder for paper items, such as memos, and the like, intended to be supported on a substantially horizontal auxiliary underlying supporting surface (such as that of a desk, for example) and adapted to support in any of a plurality of selected positions from one to a large number of small paper items such as bills, memos, and the like, and in a conveniently arranged, segregated manner such as to facilitate the subsequent handling of the more important ones of said items on what might be termed a priority basis. The multiple-item holder consists of an upstanding portion and a plurality of spaced laterally directed arms, thus providing a very substantial measure of visibility and not obscuring a person's view and making it possible to magnetically (or otherwise) attach or engage any desired number of small clamping devices to any portion of the device and to clampingly engage corresponding paper items which will be supported at the selected locations. In a preferred arrangement, the device is so arranged that the lower portions of supported paper items will lie behind lower adjacent transverse arms of the device so as to avoid obscuring the top portion of each paper item and a title or designation marking which may be removably carried by any of the transverse arms at any desired location to indicate the nature of adjacent supported paper items and possibly the order of priority of the handling of same. In a preferred form, the paper-item-holding clamp means may be magnetically mountable on any ferromagnetic surface portion of the transverse arms, and the clamping jaws thereof provide for the easy clamping and unclamping of the paper items. Also, in a preferred form, the title or designation markings may be magnetically attached to the transverse arms at any desired location and in a manner which does not in any way interfere with the attachment at the same location of one or more of the paper-holding clamp devices. In one preferred form, the device is provided with a substantially non-tippable base member and means for supporting at least one tray or shelf (preferably more than one such tray or shelf) and also an open-topped cup-shaped receptacle to facilitate the storage of the numerous small desk top items customarily found on a desk, including writing instruments, erasers, paper clips, stapler, and the like. Also, in one preferred form, the device may be optionally provided with means for mounting a controllably removable and interchangeable visible display means, usually at the top thereof.

9 Claims, 14 Drawing Figures

FIG. 1
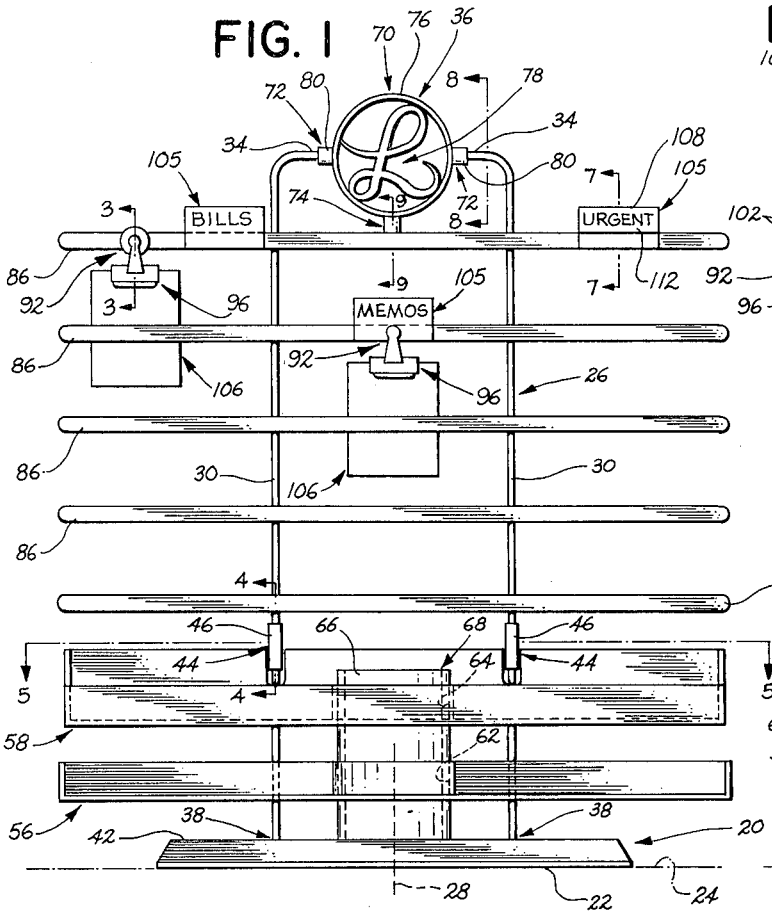
FIG. 3
FIG. 2
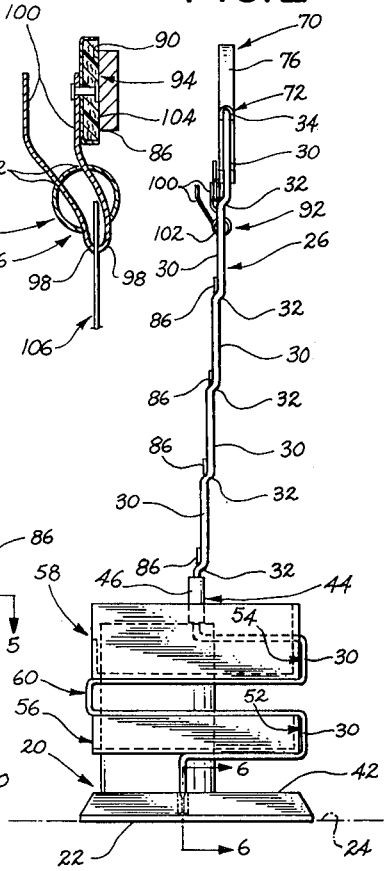
FIG. 5
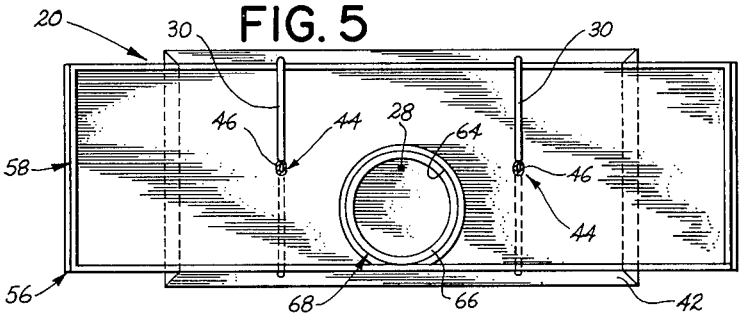
FIG. 8
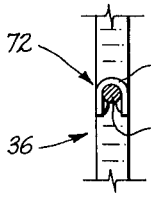
FIG. 9
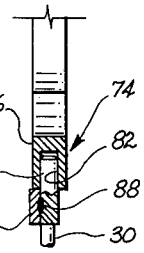
FIG. 4
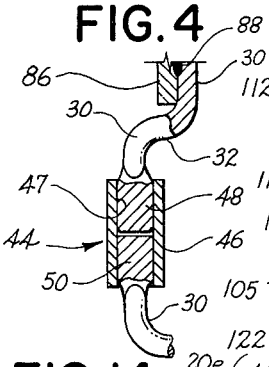
FIG. 7
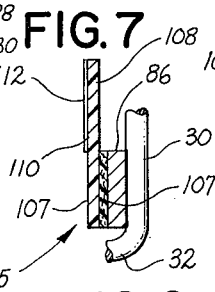
FIG. 10
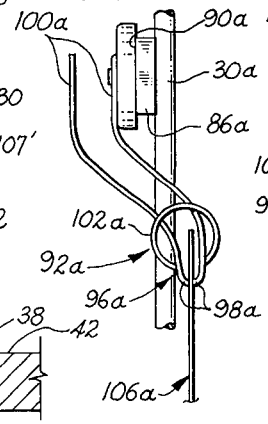
FIG. 11
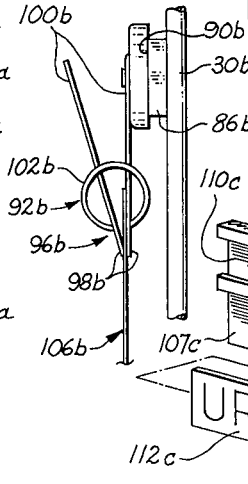
FIG. 13
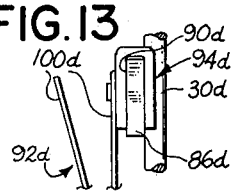
FIG. 12
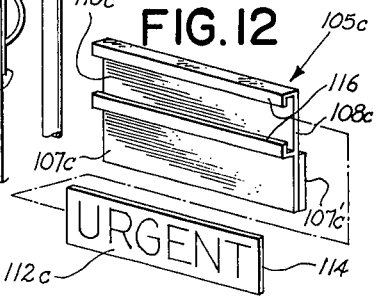
FIG. 6
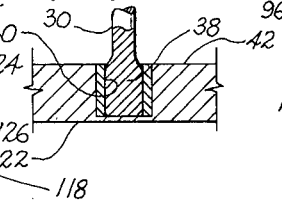
FIG. 14
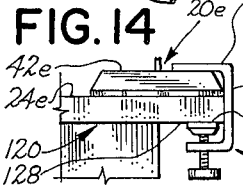

MULTIPLE PAPER ITEM HOLDER

BACKGROUND OF THE INVENTION

The field of the invention is generally that of office equipment of the type adapted to be placed on a desk for the purpose of facilitating the temporary segregation and storage of paper items, such as memos, bills, urgent letters, and the like, which require some action on the part of the recipient and which, after receipt, will usually be at least partially segregated and placed in such equipment so as to be available for use when a subsequent action or response thereto is to be effected by the recipient thereof. For example, in many offices a series of several vertically-spaced, stacked trays sometimes marked "Outgoing" and "Incoming" or sometimes marked "Bills" or "Urgent," or bearing other similar designations, may be employed for the purpose of temporarily storing segregated bills, leters, and other received paper items so that the recipient will be aware of where they can be found when he wants to respond thereto and also will know that the more urgent ones are in a correspondingly indicated portion of the storage unit. However, such prior art desk-top paper item organizers or collectors are not very efficient since once an item is placed therein and stacked upon another item, the item upon which is has been stacked cannot readily be seen and the old expression of "out of sight, out of mind" comes into play. In fact, it can be said that the last item placed in such a desk-top storage tray will be the only one which is acutally visible to a user of the desk, while the other paper items stacked lower down may be forgotten or ignored until such time as each paper item is individually removed from the stack thereof and is again individually examined. It is obvious that it would be extremely desirable to segregate, collect, and temporarily store multiple receive paper items in an order-of-importance category or priority, fashion, or manner and in a manner where all such temporarily stored paper items are virtually equally visible and equally accessible to a user of the device sitting at a desk upon which it is mounted. It is precisely for the purpose of providing an improved multiple-paper-item-holder having the advantages mentioned immediately above that the present invention has been developed, since it provides an equal visibility, equal access, multiple-paper-item-holder having the above-mentioned novel advantages, all of which flow from, and occur by reason of, the specific features of the invention pointed out hereinafter.

Summary of the Invention

Generally speaking, the multiple-item-holder for paper items and the like of the present invention comprises a substantially non-tippable base member adapted to rest on a substantially horizontal, auxiliary underlying supporting surface (such as a desk top or the like, although not specifically so limited in all forms of the invention) which is provided (usually removably) with upstanding supporting framework means carrying a plurality of vertically spaced, transversely directed supporting arms and also including a plurality of clamp devices adapted to be mounted at virtually any desired location relative to any of the transverse supporting arms to temporarily support and position a paper item therebelow (and, in a preferred form, behind the next lower adjacent transverse supporting arm), and with a preferred form of the invention also including title or designation marking means adapted to be mounted at any desired location with respect to any of the transverse supporting arms for indicating the adjacent area as being suitable for the temporary positioning of a certain segregated class of paper items or the like, thus making it possible to effectively classify, segregate, and mount in a selected area any paper item which it is desired to temporarily classify and store until it is responded to or acted upon. In a preferred form, the framework means carrying the transverse supporting arms and the base supporting the framework means may be arranged to removably carry one or more object-supporting trays or shelves and/or a cup-shaped receptacle for long objects such as pens, pencils, and the like, to enhance the overall utility of the device. In one preferred form, the framework means is provided with means for visibly mounting any selected type of visible display means, such as the person's initials, an emblem associated with some organization, group, company, or the like, with which the person is associated, or it may display virtually any selected type of display means or emblem. In a preferred form, the base member, the framework means, the shelf or tray means, and the cup-shaped receptacle means (when employed) may all be of effectively disassembled or knocked-down construction to facilitate small-space-volume storage and shipping requirements of the device when stored or shipped and prior to assembly for operative use.

Objects of the Invention

With the above points in mind, it is an object of the present invention to provide a novel multiple-item-holder for paper items, such as memos, or the like, and which is of a character such as is referred to herein generically and/or specifically, and which may include any or all of the features referred to herein (or functional equivalents), either individually or in combination, and which is of extremely easy-to-mount-and-assemble and easy-to-use construction suitable for use by relatively inexperienced persons, and which is of relatively simple, inexpensive, easy-to-manufacture and easy-to-store-and-ship construction suitable for ready mass production and distribution thereof in any of its various forms at relatively low cost, both as to the initial capital cost (including production set-up cost) and as to the subsequent per-unit manufacturing cost, whereby to be conducive to widespread production, distribution, and sale of the novel multiple-item-collector and segregated or classified holder of the present invention as a disassembled, knocked-down, easy-to-ship and easy-to-store unit adapted for easy assembly after delivery, or as an initially completely assembled unit, intended for the purposes outlined herein or for any substantially equivalent or similar purposes.

Further objects are implicit in the detailed description which follows hereinafter (which is to be considered as exemplary of, but not specifically limiting, the present invention), and said objects will be apparent to persons skilled in the art after a careful study of the detailed description which follows. For the purpose of clarifying the nature of the present invention, several exemplary embodiments of the invention are illustrated in the hereinbelow-described figures of the accompanying single drawing sheet and are described in detail hereinafter.

BRIEF DESCRIPTION OF THE DRAWING

FIG. 1 is a reduced-size, front elevational view of one exemplary representative form of the invention in fully assembled, upstanding, operative use supported by an auxiliary, horizontal supporting surface, such as a desk top surface indicated fragmentarily in phantom lines only.

FIG. 2 is a right-side elevational view of the exemplary representative first form of the invention shown in FIG. 1.

FIG. 3 is a somewhat-enlarged, fragmentary, vertical-plane, cross-sectional view taken along the plane and in the direction indicated by the arrows 3—3 of FIG. 1 (in cross-section with respect to all portions of the device except the fragmentarily-shown paper item held by the device, which is shown fragmentarily in side elevation).

FIG. 4 is a fragmentary, enlarged view substantially comprising a sectional view (with certain fragmentary portions shown in side elevation, however) taken substantially along the plane and in the direction indicated by the arrows 4—4 of FIG. 1 and clearly illustrates an exemplary representative one of the coupling means which facilitate the initial storage and shipment of the entire device in disassembled, small-space-volume configuration, but adapted to be readily assembled into the operative condition shown in FIGS. 1-9 inclusive.

FIG. 5 is a top view taken substantially along the plane and in the direction indicated by the arrows 5—5 of FIG. 1.

FIG. 6 is an enlarged, fragmentary, sectional view taken substantially along the plane and in the direction indicated by the arrows 6—6 of FIG. 2 and shows one representative, exemplary, base-attaching engaging or engagement means to facilitate the assembly and disassembly of the device for convenience in shipping and storing the entire device in a small-space-volume configuration.

FIG. 7 is a somewhat enlarged, fragmentary, cross-sectional view taken substantially along the plane and in the direction indicated by the arrows 7—7 of FIG. 1 and illustrates the structure and mounting of one representative exemplary form of title or designation marking means for indicating the kinds of paper items to be temporarily stored in an adjacent (usually underlying) region.

FIG. 8 is an enlarged, fragmentary view taken substantially along the plane and in the direction indicated by the arrows 8—8 of FIG. 1 and illustrates a portion of one exemplary form of visible display supporting means and visible display means supported thereby.

FIG. 9 is en enlarged, fragmentary view, taken substantially along the plane and in the direction indicated by the arrows 9—9 of FIG. 1 and illustrates another optional portion of the representative visible display supporting means and the representative visible display means supported thereby as best shown in FIG. 1.

FIG. 10 is a view similar in many respects to FIG. 3, although it is in end or side elevation rather than in section, and further illustrates a slight modification of the invention wherein the upstanding framework means is not provided with a plurality of progressively rearwardly displaced, stepped portions in the manner of the first form of the invention as best shown in FIG. 2.

FIG. 11 is another fragmentary, side elevational view generally similar to FIGS. 3 and 10, but illustrates a slightly modified form of paper-item-holding clamp device.

FIG. 12 is an exploded isometric view of a modified form of the title or designation marking means shown in front elevation in FIG. 1 at three different locations, and shown in side section in FIG. 7, in a representative first form thereof. The FIG. 12 exploded, isometric showing illustrates a very slight variation thereof.

FIG. 13 is a fragmentary, partially broken-away, side elevational view similar to FIG. 3 with the exception that FIG. 3 is sectional in nature, and illustrates a different type of mounting portion for the paper-item-holding clamp means which is not of a magnetically attachable or engageable nature in contrast to the mounting portion of the first form of the invention.

FIG. 14 is a very fragmentary view illustrating an auxiliary base-member-stabilizing clamp for use in firmly attaching the base member of any of the various forms of the invention to an auxiliary underlying supporting member (such as a desk top, or the like), and merely illustrates one of many possible representative exemplary types of such base-member-stabilizing clamps, for illustrative purposes only.

DESCRIPTION OF THE PREFERRED EMBODIMENTS

An exemplary representative first form of the invention is illustrated in FIGS. 1-9 inclusive wherein the multiple-item holder includes a base member, such as is generally designated by the reference numeral 20, which is of a substantially non-tippable nature by reason of its longitudinal and lateral dimensions and/or its weight, which factors may be relatively varied as long as the combined effect thereof is such as to substantially prevent tipping of the entire device when in use. It may be said that the base member 20 is effectively weighted, which may be accomplished by having it made of a relatively medium-weight or light-weight material supplemented by auxiliary weight means, or it may be accomplished by using a relatively heavy material of which to form the base member 20. The latter election is the preferred arrangement and the base member 20 may be made of metal so as to provide a substantially non-tippable base having a substantially flat bottom-contact surface 22 adapted to rest upon and be supported by a substantially horizontal auxiliary underlying supporting surface, such as that shown in phantom lines at 24 in FIGS. 1 and 2, for example, which may comprise the top surface of a desk or the like where the multiple item holder of the present invention is primarily adapted for use, although not specifically so limited.

In the example illustrated, the base member 20 is of substantially rectangular configuration, as seen in top plan view in FIG. 5, and extends in two different mutually perpendicular (but both still horizontal) directions which may be said to comprise an effective length direction and an effective width direction, the length direction extending between opposite side edges of the drawing sheet as shown in FIG. 5 and the so-called width direction extending at right angles thereto between top and bottom edges of the drawing sheet as shown in FIG. 5. It should be clearly understood, however, that the exact plan view configuration and, indeed, the entire shape of the base member 20, are not limited to the showings of the exemplary representative first form of the invention illustrated in FIGS. 1-9, which are for illustrative purposes only.

The exemplary first form of the invention also includes upstanding supporting framework means, one exemplary representative form of which is designated by the reference numeral 26, which is provided at the bottom with base-engaging or attaching means for attaching engagement with respect to the base member 20, whereby to be firmly supported thereby in a substantially centrally symmetrically positioned location with respect to central portion of the base member 20 so as to provide firm non-tipping support to the upstanding framework means 26 in virtually all directions. In the example illustrated, the central or center portion of the base member may be said generally to be that portion surrounding the geometrical center thereof, which is indicated in broken lines in FIG. 1 and by a dot in FIG. 5 designated by the reference numeral 28.

It will be noted that the upstanding supporting framework means 26, in said exemplary first form of the invention, comprises a pair of substantially rigid upstanding rod-shaped members, such as indicated at 30, which are of substantially similar configuration but are longitudinally spaced apart in the previously mentioned length direction of the base member in a manner providing longitudinal symmetrical spacing thereof on each side of the previously mentioned center portion of the base member surrounding the center point 28 thereof so as to extend upwardly therefrom on each side of the vertical center line of said center portion, also indicated by the reference numeral 28; although, in the exemplary first form of the invention as best shown in FIG. 2, being intermittently and regularly displaced in a stepped manner in a direction which corresponds to the previously mentioned width direction of the base member 20 and which is transverse to the longitudinal direction thereof and to the longitudinal plane carrying said pair of supporting members at their bottom attachment point to the base member 20 so as to provide a series of vertically spaced and progressively similarly displaced steps in the complete pair of upstanding rod-shaped members 30 of the framwork means 26. This is best shown in FIG. 2 where each of the displacement portions is indicated by the reference numeral 32, the lowermost one of which is shown in somewhat enlarged form in FIG. 4 also. It will be noted that each of the rearwardly displaced stepped portions 32 causes the next immediately upwardly adjacent part of the rod member 30 to lie in a different longitudinal plane from the next upwardly adjacent rod portion 30 positioned immediately above the next upwardly adjacent rear displacement step 32. The purpose of this series of multiple progressively rearwardly displaced planes for each of the vertically adjacent rod portions 30 will be explained in greater detail hereinafter.

In the example illustrated, the two rod-shaped upstanding members 30 of the supporting framework means 26 are provided with top terminal ends, indicated by the reference numeral 34 in each of the two instances thereof, and in the exemplary representative first form of the invention, said upper terminal end 34 of the upstanding supporting framework means 26 are formed inwardly so as to extend in a substantially horizontal line toward each other and to terminate in a manner providing a central, open display member region or space therebetween, such as is generally designated by the reference numeral 36.

In the example illustrated, the lower ends of the framework means 26 are provided with base engaging means, as indicated at 38 and which, in the example illustrated, as best shown in FIGS. 5 and 6, are of a removable type which includes male insert members 38 carried at the bottom of each of the two rod-shaped members 30 adapted to be removably inserted downwardly into corresponding female recess attaching and engaing means, indicated by the reference numeral 40 in FIG. 6 and provided in the upper surface 42 of the base member 20.

In the example illustrated, the two attaching engaging means, comprising the two insert portions 38 and the two female receiving socket portions 40 may be optionally effectively keyed by being of non-round shape or by the provision of any other type of well-known key means to properly position each of the upstanding rod members 30 and to prevent rotative displacement thereof.

It should be noted that, for ease of assembly and disassembly whereby to make it possible to store and ship the entire device in a relatively small-space-volume configuration when in disassembled relationship, the upstanding framework means 26 may be provided with quick connect and disconnect coupling means at one or more convenient assembly and disassembly locations, such as indicated generally at 44 in the exemplary first form of the invention illustrated. Said coupling means 44 may comprise a sleeve 46 adapted to receive the bottom insert member 48 carried by each of the two rod member 30 and also to similarly receive another lower insert member 50 carried by a lower portion of the rod-shaped member 30 of the framwork means 26 so that they can be effectively joined together in assembled relationship or can be effectively separated into disassembled relationship. They may be non-rotatively keyed, also, if desired, in a manner similar to the base engagement and attaching elements 38 and 40 previously described.

In the exemplary first form of the invention illustrated, lower portions of the upstanding framework means 26 are provided with laterally directed shelf-mounting recess means, such as indicated 52 and 54 (best shown in FIG. 2), for receiving and mounting therein object-supporting shelf means such as the representative lower shelf 56 and upper shelf 58 shown in FIGS. 1, 2, and 5. In the exemplary form illustrated, the two recess means 52 and 54 are formed by bending the corresponding lower rod-shaped member so as to form said two recesses 52 and 54 which, in the exemplay form illustrated are open at the front and closed at the rear and are vertically spaced apart by a vertical spacing portion indicated at 60. In the example illustrated, the lower shelf has a back wall and two side walls, but no front wall, thus forming an open-fronted shelf convenient for the purpose of placing thereon various writing instruments, memo pads, rubber stamps, stamp pads, and other small office equipment. The upper shelf 58, in the example illustrated, has two walls, a rear wall, and a front wall and, thus, comprises an open-topped but otherwise closed receptacle well adapted to contain similar small items such as paper clips, erasers, and the like, which might tend to become accidentally displaced from the open fronted lower shelf 56. However, in the example illustrated, the back wall and the two end walls of the upper shelf of 58 are of greater vertical height than the front wall thereof. This facilitates the placing of small memo pads in an inclined and at least partially upstanding relationship against the high rear wall of the upper shelf 58 so they will be in plain view for use. It will be noted that the reason that the higher rear wall is provided on the upper shelf 58 rather than on the lower shelf 56 is because there is substantial clearance space above the upper shelf 58 which facilitates the provision of such an upwardly extended rear wall. In the example illustrated, in order to facilitate the mounting of the upper shelf 58 in the upper recess 54, despite the provision of the upwardly extended rear wall, which is deeper than the recess 54, said rear wall is slotted at the locations of the two upper rearwardly extending portions of the two rod-shaped members forming the upper boundary of the upper recess 54. However, various other means providing for appropriate mounting of the upper shelf 58 irrespective of whether or not it has an upwardly extending rear wall, may be employed in lieu of the exemplary arrangement illustrated and described in the drawing. The extended upper rear wall may be eliminated entirely or the extended portion of the end walls may be eliminated entirely, or either may be provided on the lower shelf 56 if desired. Also, in the preferred arrangement illustrated, the upper shelf 58 is of slightly smaller size than the lower shelf 56 so as to facilitate the stacking of one within the other for reducing the space volume required for stacking and storing the entire device when in disassembled storage and shipping form. In this connection, it should be clearly understood that this invention does not lie in the exact construction and arrangement of the shelves or in the question of whether or not they are open or closed at the top, or in the number of such shelves or in the positioning of such shelves. All of these convenient structural arrangements are subject to substantial variation and the invention is certainly not to be specifically so limited. In the example illustrated, the shelves 56 and 58 are preferably made of light-weight, molded plastic construction and, in certain forms thereof, may preferably be also of a translucent or transparent type to facilitate visibility. However, the invention is not specifically so limited in all forms thereof. It should also be noted that in the exemplary form illustrated the two shelves 56 and 58 are provided with vertical, through-passing vertical apeture means, such as indicated at 62 and 64, at a central location so as to be capable of receiving upwardly therethrough the circular side wall portion 66 of a centrally positioned, upwardly open, object reciver, indicated generally at 68, and, in the example illustrated, taking the form of a cylindrically-shaped, open-topped cup in which relatively lengthy objects, such as pencils, pens and the like, may preferably be positioned for convenient access.

The previously mentioned upper terminal end 34 of the upstanding framework means 26 are adapted to be provided with visible display means, and visible display supporting means, one exemplary form of which is indicated generally at 70 in the case of one representative type of visible display means and such as indicated generally at 72 and 74 in the case of one representative form of visible display play supporting means. In the exemplary form illustrated, the representative visible display meanas 70 comprises a ring-shaped member 76 carrying a particular display structure 78 therein and which, in the example illustrated, comprises an initial. However, it could just as well comprise an emblem representing a lodge, an organization, or any group, sect, creed, or other type of organization with which one perhaps is affiliated or is a member of and, therefore, wishes to display same, or perhaps it is of an honorary character or indictes one's qualifications, prefession, or activities. In other words, the display means 70 may assume virtually any form which is desired. In the example illustrated, the display supporting means 72 and 74 comprise a pair of laterally positioned, controllably manually fastenable and unfastenable fastening means of a slip-over spring-clamp type, such as indicated at 80 in FIG. 8, for example, adapted to slip over the terminal end 34 of the corresponding upper part of the rod-shaped member 30 in an easily fastenable and unfastenable manner. Also, in the exemplary first form illustrated, the remaining display supporting means, indicated generally at 74, comprises a bottom receiver 82 carried at the bottom of the ring memer 76 adapted to be slipped over an upwardly directed projecting pin 84 carried at the center of an upper transverse member 86 which will be described hereinafter. It should be clearly understood that, in certain instances, it may be possible to eliminate either the supporting means 74 or the supporting means 72 rather than to employ both of same simultaneously. This is optical, as is the substitution in lieu thereof of various other types of display supporting means, all of which are intended to be included and comprehended within the broad scope of the present invention.

The upstanding rod-shaped memers 30 of the framework means 26 carry a plurality of substantially horizontally directed, vertically spaced, transverse supporting arms, each of which is designated by the reference numeral 86 and each of which is attached in any suitable or appropriate manner to corresponding portions of the pair of rod-shaped members 30 of the framework means 26, in each case being attached to a different one of the progressively rearwardly displaced stepped portions of the rod-shaped members 30 most clearly shown in FIG. 2 so that each one of the vertically adjacent, transverse supporting arms 86 lies in a plane slightly behind the next lower adjacent one of the transverse supporting arms 86, as is best shown in FIG. 2. In the example illustrated, the attachment of each of the transverse supporting arms 86 to corresponding portions of the rod-shaped members 30 is by welding or other mechanical attachment, as is best shown at 88 in FIG. 4. However, the attachment may be by various adhesive means, cohesive means, mechanical fasteners, or any other suitable type of attachment means and is not specifically limited to welding, such as shown at 88 in FIG. 4.

It should be noted that the transverse supporting arms 86 have ferromagnetic frontal surfaces whereby to comprise magnetically attractable paper-holding clamp means mounting surfaces, as is best indicated at 90 in FIG. 3. These may be provided on an otherwise nonferromagnetic, transverse supporting arm 86. However, in the exemplary preferred form illustrated, each entire transverse supporting arm 86 is made of such ferromagnetic material so that all surfaces thereof effectively comprise such ferromagnetic, magnetically attracable mounting surfaces.

The invention also includes one or more (usually a substantial plurality of) magnetically mountable clamp means, such as the representative one shown at 92 in FIGS. 1 and 3, which can be magnetically mounted on any of the ferromagnetic surfaces 90 of any of the transverse supporting arms 86 at any desired location. This is made possible by reason of the fact that each such magnetically mountable clamp means 92 includes a magnetic mounting portion 94 cooperable and controllably selectively placeable, in magnetically-held mounting attachment with respect to any selected ferromagnetic surface portion 90 of any of the transverse supporting arms 86, and with each such magnetically mountable clamp means 92 also including a controllably operable paper-engaging- and disengaging clamp portion, such as is indicated at 96, which includes a pair of opposed jaws 98 and a clamp-operating portion comprising two upper operating arms or members 100 effectively pivotally interconnected in effective fulcrum manner at a pivot location such as is indicated at 102 and effectively spring-biased in a direction such as to cause the jaws 98 to be biased toward closed relationship with respect to each other. It will be noted that it is the rear side of one of the operating arms 100 which mounts the magnetic mounting portion 94 which, in the example illustrated comprises an elastomeric magnet 104 of the type having an elastomeric or rubber-like matrix material carrying disseminated therethrough ferromagnetic particles which are permanetly magnetized so as to together comprise a resilient compressible permanent magnet 104 which will be magnetically attracted to any of the ferromagnetic surfaces 90 of any of the transverse supporting arms 86 and be magnetically held in engagement therewith until manually disengaged and removed therefrom when desired.

Thus, it will be understood that it is possible to place any small sheet of paper within the opposed jaws 98 comprising a clamp portion of the magnetically mountable clamp means 92 and to magnetically mount the magnetic portion 94 on any part of any of the multiple ferromagnetic surfaces 90 of any of the transverse supporting arms 86 so as to mount, hold, and display the particular small sheet of paper in a desired location with respect to the entire multiple item holder.

In the exemplary stepped arrangement of the framework means 26 shown in the first form of the invention, the rearward displacement stepped portions 32 may be of sufficient magnitude to readily allow such a mounted sheet of paper, indicated by the reference numeral 106, to lie behind the next lowermost transverse arm 86 so as to not obscure it from the front, or the magnetically mountable clamp means 92 may be of effectively rearwardly displaced configuration, as best shown in FIG. 3, wherein the upper operating arms 100 are forwardly displaced from the lower paper grasping jaw means 98 so that the paper item 106 can readily be positioned behind the next lower adjacent transverse supporting arm 86 in the manner shown in both FIGS. 1 and 2. Both of these two arrangements are intended to be included and comprehended within the broad scope of the disclosure of the present invention.

The rearwardly progressively vertically stepped relationship of the upstanding rod-shaped members 30 of the supporting framework means 26, in certain forms of the invention, where the rear positioning of a paper item 106 is not thought to be important or necessary, may be of a substantially non-displaced configuration extending directly upwardly, and such an arrangement is fragmentarily illustrated in FIG. 10 and will be briefly referred to hereinafter.

FIG. 7 illustrates one exemplary, representative form of title or designation marking holding and mounting apparatus, which is generally indicated by the reference numeral 105. In the representative exemplary form illustrated, it comprises a thin attachment plate 107, which comprises a permanent magnet, which may be made of metallic ferromagnetic material 107', or may be made of such a plate 107 provided at its rear with a compressible, elastomeric, ferromagnetic material of a type similar to that employed in the magnetic mounting portion 94 of the mounting clamp means 92. Of course, the ferromagnetic material of which the attachment plate 107 (and 107' in the form shown) is made is permanently magnetized so as to be magnetically attracted to the ferromagnetic surface 90 of any of the transverse arms 86 so that the title mounting member 105 may be mounted at any desired location.

It should be understood that the mounting of the title mounting means 105 on any particular surface portion 90 of any of the transverse arms 86 will not prevent the mounting at the same location of any one of the previously described mounting clamps 92 since its magnetic mounting portion 94 may merely be placed on the front side of the mounting magnetic plate 107 (and 107') which will cause both to be magnetically attracted to the corresponding ferromagnetic surface 90 of the arm 86. Thus, it will be understood that the title mounting member 105 can be mounted separately from any of the paper-holding mounting clamps 92, as shown at the upper left corner of the apparatus in FIG. 1 for example, or they may be effectively super-imposed in the manner shown at the center portion of the apparatus of FIG. 1, or the title mounting apparatus 105 may be completely independently mounted in the manner shown at the upper right hand corner of the apparatus as in FIG. 1. In the exemplary form of the title mounting apparatus illustrated in FIGS. 1 and 7, the magnetic plate 107 is provided with display plate 108 having a title or designation display surface 110 upon which writing or printing can be produced so as to visibly display the desired title, such as the exemplary title shown at 112 in FIG. 1, for example. The title 112 may be produced by adhesively affixing a label, or the like, onto the display surface 110, with said label having been previously provided with a desired title, such as by typing, writing, or hand-lettering same thereon, or otherwise producing the title on the label surface either before or after affixing same to the display surface 110.

Alternatively the title 112 may be produced on the display surface 110 by actually writing or hand-lettering same directly, thereon, by using an appropriate lettering or writing tool, such as a grease pencil, a ball point pen, a felt pen, or other equivalent writing instrument. In certain forms of the invention, the display surface 110 may be of a nature such as to facilitate such hand-writing or hand-lettering of the title directly thereon. For example, when the display surface 110 is made of plastic material, it may be of a type having a very slight surface roughness so as to facilitate writing thereon as opposed to the usual rather glossy plastic surface upon which writing is relatively difficult. Also, various other means for producing a visibly observable title, such as the representative one shown at 112, may be employed in lieu of the specific arrangement described, and all such are intended to be included and comprehended within the broad scope of the present invention.

The purpose of the title mounting apparatus 105 is to make it possible to effectively designate certain portions of the entire device for the mounting of certain particular kinds of corresponding paper items so that they can be quickly found by a user of the device. Also, in such title mounting apparatus, the title may make it possible to indicate the urgency or the order of priority of handling of the paper items mounted in different portions of the complete device so that it will be possible to handle the more urgent items on a proper priority basis and without the necessity of again examining all of the paper items to determine the propr priority orer each time such item handling is to be done.

FIG. 10 illustrates a very slight modification of the first form of the invention as illustrated in FIGS. 1–9 inclusive. In this modification all parts which are similar, structurally or functionally, to corresponding parts of the first form of the invention are designated by similar reference numerals followed by the letter *a*, however. In this modification the major change from the first form of the invention, is the fact that each of the rod-shaped members 30a is substantially straight and does not include the series of rearwardly directed steps, such as those shown at 32 in the first form of the invention. This means that if the paper holding clamp **92*a* is of the effectively bent type shown in FIG. 3 illustrating the first form of the invention, it will, of necessity, require a greater bend, or displacement, of the lower jaw clamping portion 96*a* than is required in the first form of the invention, as illustrated in FIG. 3, if each sheet of paper held by the clamp portion 96*a* is intended to lie behind the next lower transverse arm 86*a* in a manner generally similar to the rear positioning of the paper items as shown in the first form of the invention. On the other hand, if a straight clamp is employed, a sheet of paper held thereby will lie in front of the next lowermost transverse arm, and either arrangement may be desirable under some circumstances. The bent clamp arrangement is clearly shown in FIG. 10 while the straight clamp arrangement is clearly shown in FIG. 11**, wherein similar parts are designated by similar reference numerals always followed by the letter *b*, however. It should be clearly understood that the straight clamp arrangement shown in FIG. 11 can also cause each sheet of held paper to lie behind the next lower transverse arm by merely providing a series of rearwardly directed displacement step portions similar to the steps shown at 32 in FIG. 2 in the first form of the invention, only of greater magnitude, and the showing of FIG. 11, taken in conjunction with the description, is intended to provide a full disclosure of such an arrangement.

FIG. 12 illustrates a slight modification of the title or designation marking mounting and holding apparatus from the first form thereof best shown in FIGS. 1 and 7. It will be noted that it consists primarily of a substantially identical structure with corresponding parts bearing similar reference numerals followed by the letter *c*, however. A magnetically mountable permanent magnet attachment plate **107*c* (and 107'c) is adapted to be attached to the front surface of any of the transverse arms, such as shown at 86 of the first form, at any desired location, and it has the upwardly extending title bearing portion 108*c* which is provided with a title display space 110*c*. However, in this modification the title or designation 112*c* is not borne directly by the title display space 110*c*, but instead is carried on the display face of a title sheet or card 114 which is adapted to be removably mounted in front of the title display space 110*c*. In the example illustrated, this is done by slidably inserting same behind the upper and lower retaining lips 116, although not specifically so limited in all forms of the invention. This arrangement allows the inter-changeable title card 114** to be prepared and easily inserted and removed, as desired, and it is clear that other substantially effectively equivalent arrangements are entirely within the broad scope of the present invention.

FIG. 13 is a view of similar aspect to FIGS. 3, 10, and 11, but illustrates a modification of the mounting portion of any of the clamp means of any of the various forms of the invention previously described and/or illustrated in any of the figures of the drawing. Therefore, parts which are similar functionally or structurally to corresponding parts of previously described forms of the invention are designated by similar reference numerals, followed by the letter *d*, however. It will be noted that, in this modification, any particular transverse arm **86*d* to which a paper-item-holding clamp means, such as is shown fragmentarily at 92*d* in FIG. 13, is to be attached need not comprise a ferromagnetic surface as designated at 90 of the first form of the invention. In the FIG. 13 modification, it may be of ferromagnetic or non-ferromagnetic material and may even be made of plastic material if it has sufficient structural strength for the purposes of the invention. The attachment of the paper-item-holding clamp member 92*d* in this modification is accomplished by a somewhat different type of mounting portion, which is inidicated by the reference numeral 94*d* and which comprises an effective hook attached to, or formed out of, the end of the ear one of the two operating arms 100*d* of the paper-item-holding clamp 92*d*. This makes it possible to merely slip on the hook 94*d* at any desired location with respect to any of the transverse arms 86*d*, with the emainder of the device being adapted to be any of the various types illustrated in the other figures of the drawings and/or previously described or referred to elsewhere in this specification. Therefore, in view of the full descriptions of the remainder of the device in any and all of its various forms, which have been set forth hereinbefore, it is believed that any further detailed description of corresponding portions of the FIG. 13** variation would be entirely redundant and, thus, are not repeated at this point.

FIG. 14 discloses an additional base-member-stabilizing structure which may be used with any of the base members of any of the various forms of the invention in the event that it is of inadequate weight and/or size to properly and fully stabilize the entire device. Whenever it is thought that the upper portions of the device will, perhaps, be top-heavy and may tend to cause the entire device to fall over, and that it would be necessary to greatly enlarge the base member in order to preven this (and such a corrective step is not thought desirable), an auxiliary base-member-stabilizing structure may be employed, one exemplary representative form of which is shown (entirely for illustrative purposes) in FIG. 14. Despite the fact that the auxiliary base-member-stabilizing structure, which is generally designated by the reference numeral 118 in FIG. 14, may be employed with any of the different base members of any of the different forms of the invention, nevertheless, in the interest of consistency, and in keeping with the part designation procedure followed in other views involving slight modificatons, the representative base member shown in FIG. 14 is designated by a reference numeral corresponding to that employed in the first form of the invention, but followed by the letter *e*, however. The phantom-line representation at **24*e* in FIG. 1 of the top surface of the so-called auxiliary underlying horizontal supporting surface, in the example shown in FIG. 14, takes the form of the top surface of a cross-sectionally shown portion of a desk top, which is generally designated by reference numeral 120. It will be noted that the base-member-stabilizing structure 118 is illustrated in a form which might be termed a modification of a C-clamp which has an upper, downwardly facing, contact member 122, an intermediate, substantially C-shaped connecting member 124, and a lower, threadedly upwardly advanceable and upwardly facing bottom-surface contact member 126. The arrangement is such that the downwardly facing, upper contact member 122 can be placed adjacent to the top surface 42e of any desired portion of the base member 20e of the entire device (the rest of which is not shown in FIG. 14 for reasons of drawing simplification and clarity), and the lower, upwardly facing, contact member 126 can be threadedly upwardly advanced into firm contact with the bottom surface 128 of the portion of the desk top or table top which is illustrated fragmentarily at 120 in FIG. 14. This will rigidly and firmly clamp the base member 20e to the top surface 24e of the desk top or table top 120 in a manner which will absolutely and positively prevent tipping of the entire device irrespective of how tall it may be and irrespective of how heavily it may be loaded in a manner which would otherwise make it top-heavy and make it subject to tipping. It should be clearly understood that the showing of FIG. 14** is representative and exemplary only, and that it is intended to include and comprehend the provision of a variety of types of base-member-stabilizing structures other than the specific arrangement illustrated for exemplary purposes, and it should be understood that, where the base is of sufficient size and/or sufficient weight, the auxiliary clamp structure may be entirely eliminated.

It should be understood that the figures and the specific description thereof set forth in this application are for the purpose of illustrating the present invention and are not to be construed as limiting the present invention to the precise and detailed specific structure shown in the figures and specifically described hereinbefore. Rather, the real invention is intended to include substantially equivalent constructions embodying the basic teachings and inventive concept of the present invention.

What is claimed is:

1. A multiple-paper-item holder comprising: a substantially non-tippable base member adapted to be supported by an underlying supporting structure; upstanding supporting framework means provided at the bottom with base-engaging means for attaching engagement with respect to said base member whereby to be firmly supported thereby, said supporting framework means comprising a pair of substantially rigid, upstanding rod-shaped members of substantially similar configuration but longitudinally spaced apart for longitudinal symmetrical spacing on each side of a central portion of said base member so as to extend upwardly therefrom on each side of a vertical centerline of said central portion of said base member; a plurality of substantially laterally directed, vertically spaced, transverse supporting arms for use in selectively mounting at desired locations with respect thereto any desired number of paper items; at least one controllably removably mountable clamp means including a controllably operable paper-item-engaging-and-disengaging clamp portion and a transverse supporting-arm-engaging mounting portion cooperable for controllably selectively placeable mounting engagement and effective attachment with respect to any selected portion of any of said transversely directed supporting arms for temporarily supporting and positioning a paper item in said clamp portion in depending relationship therebelow; said transverse supporting-arm-engaging mounting portion of each of said clamp means being of a magnetically mountable type comprising a magnetic mounting and attaching portion and wherein said transverse supporting arms have corresponding magnetic surface portions for magnetic attracting engagement therebetween whereby any of said clamp means may be magnetically mounted and supported in any selected location with respect to any portion of said magnetic surfaces of said transverse supporting arms; said pair of upstanding rod-shaped members of said supporting framework means being provided at successive upwardly spaced locations with a series of similarly displaced stepped portions whereby to cause each succeeding upwardly adjacent portion of the pair of rod-shaped members to lie in a progressively similarly displaced but substantially parallel, upwardly directed plane and wherein the depending relationship of paper items supported by said clamp means engaged and mounted with respect to each transverse supporting arm is such as to cause the depending lower portion of such a supported paper item to be positioned behind the next lower adjacent, transversely directed supported arm by reason of said sequential series of progressively displaced stepped portions of said pair of upwardly directed rod-shaped members of said supporting framework means to which each of said vertically displaced, transversely directed supporting arms is correspondingly attached, respectively.

2. A multiple-paper-item holder as defined in claim 1, wherein lower portions of said upstanding framework means are provided with laterally directed shelf-mounting recess means receiving and mounting therein at least one horizontally longitudinally oriented object-supporting shelf means.

3. A multiple-paper-item holder as defined in claim 2, including quick connect and disconnect coupling means interpositioned between a lower part of said upstanding framework means immediately above said shelf-receiving recess means and the remaining upstanding portion of said framework means to permit the easy assembly of same together from an intially disassembled knocked-down, small-space-volume-utilizing shipping and storage condition into fully-assembled, upstanding operative condition.

4. A multiple-paper-item holder as defined in claim 1, wherein lower portions of said upstanding framework means are provided with laterally directed shelf-mounting recess means receiving and mounting therein a plurality of vertically spaced, longitudinally horizontally oriented object-supporting shelf means.

5. A multiple-paper-item holder as defined in claim 4, including a centrally positioned, upwardly-open object receiver positionable on said base member at a substantially central location and extending upwardly in a longitudinally symmetrically positioned location with respect to said recess means movably carrying said object-supporting shelf means.

6. A multiple-paper-item holder as defined in claim 5, wherein said object-supporting shelf means is provided with vertical through-pass cut-out aperture means vertically receiving and allowing the passage vertically therethrough of said centrally symmetrically positioned, upwardly open object receiver when supported on a central portion of said base member.

7. A multiple-paper-item holder as defined in claim 1, wherein said base member has a pair of longitudinally spaced framework attaching and engaging means for receiving attaching engagement with respect to mating attaching engaging means carried at the bottom of said upstanding framework means.

8. A multiple-paper-item holder as defined in claim 1, wherein said supporting frame-work means is provided with terminal ends effectively comprising visible display supporting means for mounting selected visible display means is a visibly observable position.

9. A multiple-paper-item holder as defined in claim 8, including controllably removable and interchangeable visible display means and controllably manually fastenable and unfastenable/fastening means for fastening said visible display means and visible display mounting means in a selected upstanding visible display position and for controllably removing same or interchanging same when desired.

* * * * *